US009214147B2

(12) United States Patent
Price

(10) Patent No.: US 9,214,147 B2
(45) Date of Patent: Dec. 15, 2015

(54) AUDIO SIGNAL DISTORTION USING A SECONDARY AUDIO SIGNAL FOR ENHANCED CONTROL OF PSYCHO-ACOUSTIC AND MUSICAL EFFECTS

(76) Inventor: William R. Price, Groveland, MA (US)

( * ) Notice: Subject to any disclaimer, the term of this patent is extended or adjusted under 35 U.S.C. 154(b) by 615 days.

(21) Appl. No.: 13/493,066

(22) Filed: Jun. 11, 2012

(65) Prior Publication Data

US 2013/0329900 A1 Dec. 12, 2013

(51) Int. Cl.
*H03G 3/00* (2006.01)
*G10H 3/18* (2006.01)

(52) U.S. Cl.
CPC ..... *G10H 3/187* (2013.01); *G10H 2210/311* (2013.01)

(58) Field of Classification Search
CPC ..... G10H 1/0091; G10H 3/187; G10H 2210/311; H04S 7/307; H04S 3/02; H04R 1/26; H04R 3/00
USPC ..... 381/61, 120, 119, 56, 58, 62, 63, 66; 84/681, 662, 664
See application file for complete search history.

(56) References Cited

U.S. PATENT DOCUMENTS

| | | | | |
|---|---|---|---|---|
| 5,032,796 | A | 7/1991 | Tiers et al. | |
| 5,913,152 | A | 6/1999 | Hemphill | |
| 7,043,032 | B1 * | 5/2006 | Jeffs et al. | 381/101 |
| 7,145,392 | B2 | 12/2006 | Peavey et al. | |
| 7,787,634 | B1 | 8/2010 | Dahl | |
| 8,428,271 | B1 * | 4/2013 | Luke | 381/61 |
| 2005/0195983 | A1 * | 9/2005 | Chiliachki | 381/61 |
| 2006/0222183 | A1 | 10/2006 | Kushida | |

FOREIGN PATENT DOCUMENTS

| | | |
|---|---|---|
| JP | 6260847 | 9/1994 |
| JP | 2002055681 | 2/2002 |
| JP | 2003173184 | 6/2003 |

* cited by examiner

*Primary Examiner* — Vivian Chin
*Assistant Examiner* — Ammar Hamid
(74) *Attorney, Agent, or Firm* — Russ Weinzimmer & Associates, P.C.

(57) ABSTRACT

A distorter is provided that allows a musician/sound engineer to affect the operation of a distortion circuit using a second musical instrument or a sound modifier, enabling the musician/audio engineer to vary the behavior of the distorter in real time. The invention enables a musician and/or sound engineer to achieve sounds and effects that are impossible to create using conventional distorters. The invention enables a user to provide a primary audio signal representing a musical instrument that is to undergo audio signal distortion; and to provide a secondary audio signal representing a sound modifier or a second musical instrument that is used to modify psycho-acoustic and/or musical effects of the audio signal distortion. An output signal is produced having substantially non-clipped parts for conveying the sound of the musical instrument, and having clipped parts for conveying psycho-acoustic and/or musical effects responsive to the second musical instrument or the sound modifier.

12 Claims, 11 Drawing Sheets

AUDIO SIGNAL DISTORTION USING A SECONDARY AUDIO SIGNAL FOR ENHANCED CONTROL OF PSYCHO-ACOUSTIC AND MUSICAL EFFECTS

FIELD OF THE INVENTION

This invention relates to electronic modification of audio signals, and more particularly to audio signal distortion for use in the music and film industries.

BACKGROUND

When producing amplified music, for example by using electric guitars or other instruments, it is often desirable to distort the audio signal representing the sound of the instrument so as to derive different musical effects from the instrument.

When an audio signal representing the sound of a musical instrument is "distorted" by a distorter, the audio signal is typically "clipped", i.e., the amplitude is clipped beyond a threshold value, thereby creating a compressed version of the signal within the clipped portions of the signal. In most cases, the threshold value can be adjusted by the user of the distorter.

Also, the amount of limiting can be varied by the choice of configuration of the distortion circuit of the distorter, and/or can be varied by the choice of diodes that are incorporated within the distortion circuit of distorter. However, distortion circuits of this type do not provide an adjustment that enables the user to affect the operation of the distortion circuit so as to adjust the amount of limiting in any way. Thus, each distortion circuit limits the audio signal in a specific way. Consequently, a musician tends to accumulate multiple distorters so the musician can have access to a choice of distortion circuits, thereby giving the musician the ability to produce a variety of distortion effects. However, this can become expensive and/or cumbersome. Moreover, the choice of currently available distortion circuits is confined to a small number of similar-sounding distortion circuits.

SUMMARY

The invention is distortion apparatus and distortion method that provides a musician and/or a sound engineer with an ability to affect the operation of a distortion circuit, e.g. using a second musical instrument, so as to adjust the pattern of clipping of the input audio signal. Thus, the invention substantially enables the musician/audio engineer to vary the behavior of the distortion circuit of a distorter box in real time. Therefore, a musician no longer needs to accumulate multiple distorter boxes to have access to a variety of distortion effects. Consequently, a single distorter can replace a collection of conventional distorter boxes, thereby enabling the musician and/or sound engineer to save money, to enhance convenience, and to save space. Further, the invention enables a musician and/or sound engineer to achieve sounds and effects that are impossible to create using conventional distorter boxes.

A first general aspect of the invention is a method for audio signal distortion with enhanced control of psycho-acoustic and/or musical effects. The method includes: receiving a primary audio signal representing a first musical instrument to undergo audio signal distortion; receiving a secondary audio signal representing a second musical instrument used to modify psycho-acoustic and/or musical effects of the audio signal distortion; equally combining the primary audio signal with the secondary audio signal to provide a combined audio signal; distorting the combined audio signal to provide a distorted signal; and combining the distorted signal with the secondary audio signal so as to produce an output signal having non-clipped parts that substantially convey the sound of the first musical instrument, and having clipped parts that convey psycho-acoustic and/or musical effects responsive to the second musical instrument.

In some embodiments, distorting the combined audio signal to provide a distorted signal includes inverting the distorted signal.

In some embodiments, the secondary audio signal is inverted prior to combining the distorted signal with the secondary audio signal.

In some embodiments, combining the distorted signal with the secondary audio signal is performed in a non-equal ratio.

In some embodiments, the method further includes adjustably attenuating the secondary audio signal before equally combining the distorted signal with the secondary audio signal so as to produce the output signal.

In some embodiments, providing the secondary audio signal is accomplished by modifying the primary audio signal.

In some embodiments, the method further includes delaying the secondary audio signal before combining the distorted signal with the secondary audio signal.

Another general aspect of the invention is an apparatus for audio signal distortion with enhanced control of psycho-acoustic and/or musical effects. The apparatus includes: means for receiving a primary audio signal representing a first musical instrument to undergo audio signal distortion; means for receiving a secondary audio signal representing a second musical instrument used to modify psycho-acoustic and/or musical effects of the audio signal distortion; means for equally combining the primary audio signal with the secondary audio signal to provide a combined audio signal; means for distorting the combined audio signal to provide a distorted signal; and means for combining the distorted signal with the secondary audio signal so as to produce an output signal having non-clipped parts that substantially convey the sound of the first musical instrument, and having clipped parts that convey psycho-acoustic and/or musical effects responsive to the second musical instrument.

In some embodiments, the means for distorting the combined audio signal to provide a distorted signal includes means for inverting the distorted signal.

In some embodiments, the apparatus further includes means for inverting the secondary audio signal prior to combining the distorted signal with the secondary audio signal.

In some embodiments, the means for combining the distorted signal with the secondary audio signal includes means for performing combining in a non-equal ratio.

In some embodiments, the apparatus further includes means for adjustably attenuating the secondary audio signal before equally combining the distorted signal with the secondary audio signal so as to produce the output signal.

In some embodiments, the apparatus further includes means for modifying the primary audio signal so as to provide the secondary audio signal.

In some embodiments, the apparatus further includes means for delaying the secondary audio signal before combining the distorted signal with the secondary audio signal.

Another general aspect of the invention is an apparatus for audio signal distortion with enhanced control of psycho-acoustic and/or musical effects. The apparatus includes: an input capable of receiving a primary audio signal representing a first musical instrument to undergo audio signal distortion; an input capable of receiving a secondary audio signal representing a second musical instrument used to modify psycho-acoustic and/or musical effects of the audio signal distortion; an audio mixer capable of combining the primary audio signal with the secondary audio signal to provide a combined audio signal; a distorter capable of distorting the combined audio signal to provide a distorted signal; and a mixer capable of combining the distorted signal with the secondary audio signal so as to produce an output signal having non-clipped parts that substantially convey the sound of the first musical instrument, and having clipped parts that convey psycho-acoustic and/or musical effects responsive to the second musical instrument.

In some embodiments, the distorter capable of distorting the combined audio signal to provide a distorted signal includes an inverter capable of inverting the distorted signal.

In some embodiments, the apparatus further including an inverter capable of inverting the secondary audio signal prior to combining the distorted signal with the secondary audio signal.

In some embodiments, the mixer capable of combining the distorted signal with the secondary audio signal includes an attenuator capable of attenuating an input signal so as to combine the distorted signal with the secondary audio signal in a non-equal ratio.

In some embodiments, the apparatus further includes an adjustable attenuator for adjustably attenuating the secondary audio signal before equally combining the distorted signal with the secondary audio signal so as to produce the output signal.

In some embodiments, the apparatus further includes a sound modifier capable of modifying the primary audio signal so as to provide the secondary audio signal.

DETAILED DESCRIPTION

Figure 1A:
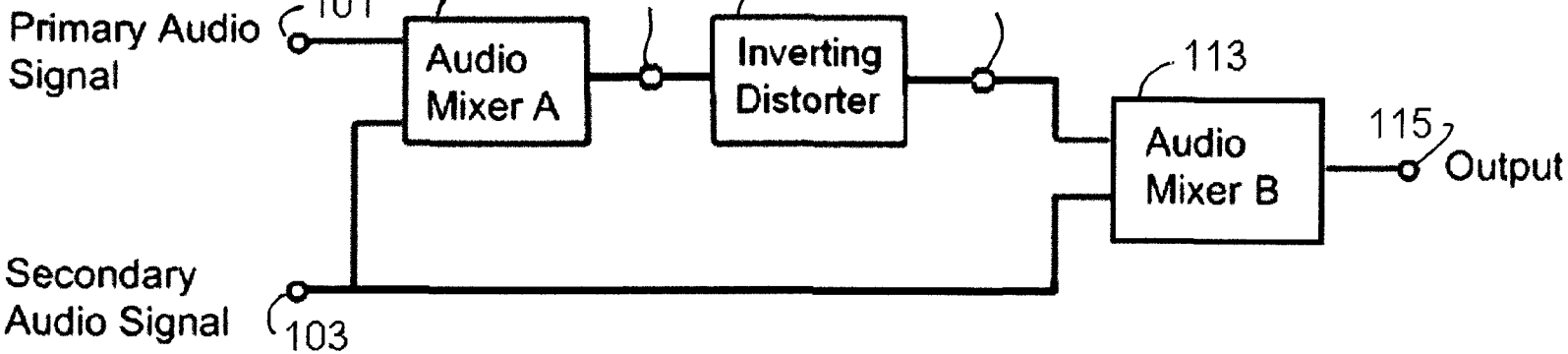
FIG. 1A is a schematic circuit diagram showing an embodiment of the invention having an inverting distorter and a second audio mixer having an input ratio of 0.6 to 1.

FIG. 1A shows a basic embodiment of the invention which combines a Primary Audio Signal 101 (e.g., provided by an electric guitar output) and a Secondary Audio Signal 103 (e.g., provided by the output of a second electric musical instrument). The signals are combined by a first audio mixer A 105 which mixes them in equal proportion, and then the sum 107 of the signals 101 and 103 is distorted and inverted by an Inverting Distorter 109 so as to provide the inverted distorted signal at output 111. The output 111 from the Inverting Distorter 109 is next combined with the secondary audio signal 103 at audio mixer B 113 to produce the output signal 115.

Figure 5A:
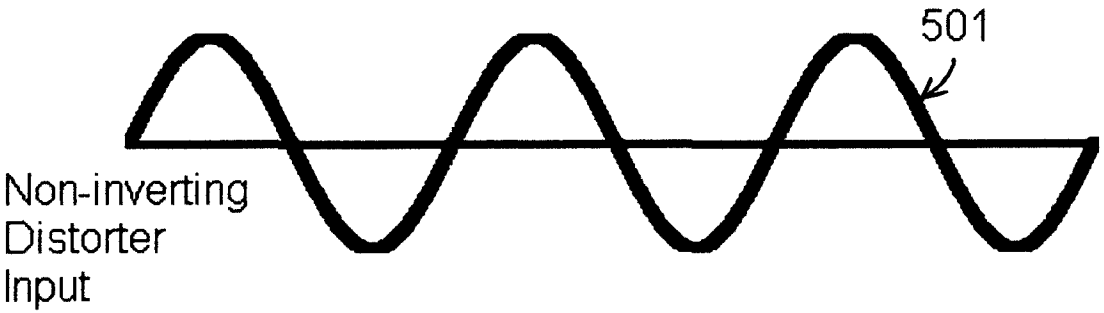
FIG. 5A shows a signal waveform prior to input to a non-inverting distorter.
Figure 5B:
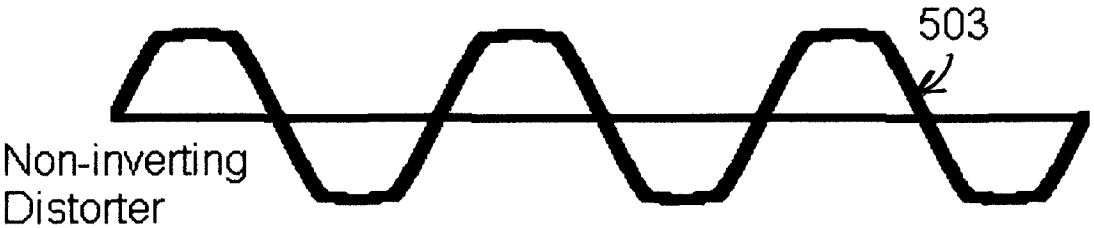
FIG. 5B shows a distorted signal waveform resulting from the signal waveform of FIG. 5A being processed by a prior art distorter.

To understand the nature of the output signal 115 of the invention, it will be helpful to first understand the behavior of a typical non-inverting distorter. Referring to FIG. 5A, for example when input wave 501 is input to a non-inverting distorter, the result is a clipped output wave 503, as shown in FIG. 5B.

Figure 5C:
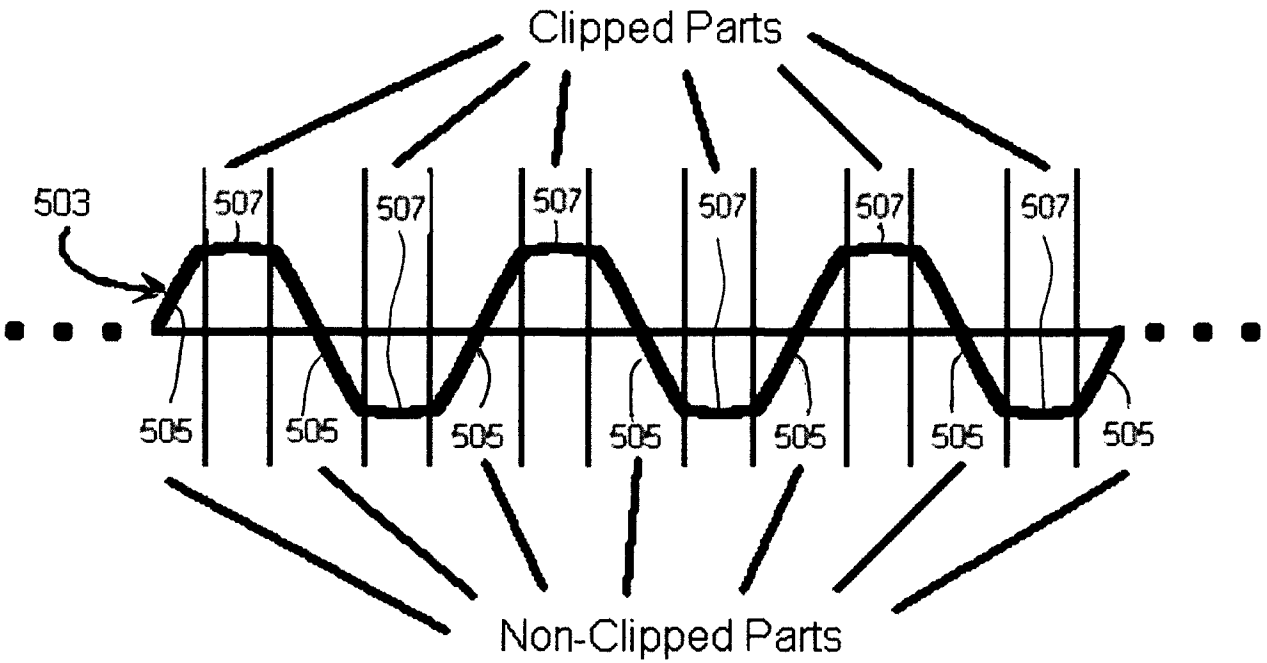
FIG. 5C shows the output waveform of FIG. 5B illustrating how a waveform can be partitioned into a plurality of Non-Clipped parts interleaved with a plurality of Clipped parts.

Referring to FIG. 5C, the output waveform 503 can be viewed as consisting of an alternation of non-clipped parts 505 and clipped parts 507, where the non-clipped parts 505 resemble corresponding parts of the input wave 501, and the clipped parts 507 represent compressed parts of the input wave 501.

Generally, a distorter allows parts of a wave that fall below an adjustable amplitude threshold to pass substantially unaltered, while causing other parts of the signal that are above an adjustable amplitude threshold to be substantially clipped, i.e. compressed to some extent determined by configuration of the distorter.

Figure 5D:
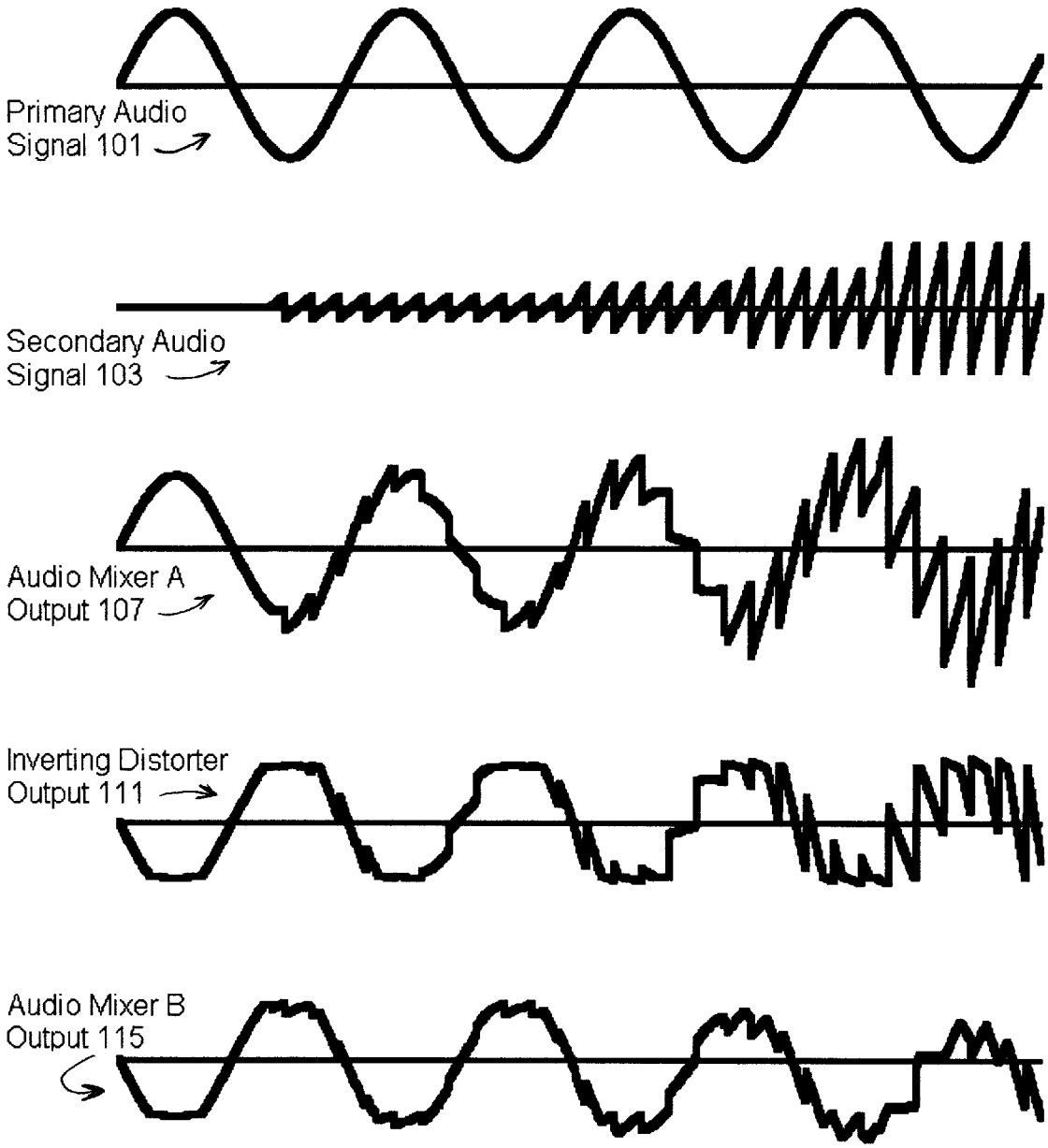
FIG. 5D shows the signal waveforms at various points in the circuit of FIG. 1A, including the Primary Audio Signal, the Secondary Audio Signal, the Output Signal, and the intermediate signals that are produced by the 1:1 Audio Mixer and the Inverting Distorter.

Referring to FIG. 5D for sample wave traces of the signals 101, 103, 107, 111, and 115 of FIG. 1A, the sample Primary Audio Signal 101 is depicted as a simple sine wave. The Secondary Audio Signal 103 is depicted as a sawtooth waveform of five amplitudes of increasing magnitude. The Output of Audio Mixer A 107 shows the "1 to 1" ratio addition of the Primary Audio Signal 101 and the Secondary Audio Signal 103. The Output 111 of the Inverting Distorter 109 shows the inversion and clipping of the Output 107 of Audio Mixer A 105. Finally, the Output 115 of Audio Mixer B 113 shows the addition of the Secondary Audio Signal 103 to the Output 111 of the Inverting Distorter 109 in a ratio of "0.6 to 1" respectively.

Note that the act of adding a 0.6 attenuated version of the Secondary Audio Signal 103 within Audio Mixer B 113 has the effect of substantially smoothing the Non-Clipped Parts of the Output 115, thereby creating the audio illusion of substantially reversing the addition of the Secondary Audio Signal 103 to the Primary Audio Signal 101 by the Audio Mixer A 105, while also perceptibly modifying the distortion of the Primary Audio Signal 101.

Also note that the act of adding the 0.6 attenuated version of the Secondary Audio Signal 103 by the Output of Audio Mixer B 115 has the effect of selectively modulating the waveform of the clipped parts of the Primary Audio Signal 101, thereby creating a unique audio effect whereby the perceived distortion of the Primary Audio Signal 101 is controlled by changes to the Secondary Audio Signal 103. Further, at higher amplitudes of the Secondary Audio Signal 103, such as by using an attenuation factor that is higher than 0.6 within or prior to the Audio Mixer B 113, subtle audio ghosting of the Secondary Audio Signal 103 enhances the perceived distortion of the Primary Audio Signal 101. At still higher amplitudes of the Secondary Audio Signal 103, more pronounced audio ghosting of the Secondary Audio Signal 103 more assertively synergizes with the perceived distortion of the Primary Audio Signal 101.

Typical distorters tend to sound monotonous when applied to steady amplitude instruments, such as an electric organ, because the dynamics of the boundary between the clipped and non-clipped parts of the waveform are excessively stable. By contrast, the invention enables injection of enhanced instability at the boundary between the clipped and non-clipped parts of the waveform, resulting in increased richness and pleasurableness of the perceived distortion. Thus, the invention enables distortion to be applied to a wider variety of instruments and other sound sources.

When using typical distorters, with a guitar for example, the musician can change the sound of the distortion by increasing the amount of clipping. However, the more clipping introduced, the less the original sound of the guitar can be heard due to the loss of more sound information represented by the waveform. To change the sound of the distortion without compromising the clarity of the sound of the guitar, the musician would need to change the sound of the guitar. Thus, it was impossible to change the sound of the distortion without changing the sound of the guitar, or cutting out significant aspects of the essential sound of the guitar.

The invention allows a musician to change the sound of the distortion without changing the sound of the guitar, and without changing the amount of clipping. This is accomplished in part by adding the Secondary Audio Signal to the Primary Audio Signal, and then clipping the wave sum, such that the dynamics of the boundary between the clipped and unclipped parts can be controlled by changing the Secondary Audio Signal instead of by changing the Primary Audio Signal and/or the clipping threshold. Further, by subtracting an inverted and attenuated version of the Secondary Audio Signal from the clipped wave sum, the purity of the wave shape of the non-clipped parts of the Primary Audio Signal is substantially restored, while also changing the wave shape of the clipped parts from merely compressed, to a sum of the inverted attenuated Secondary Audio Signal and the compressed version of the wave sum, so as to impose an entirely new wave shape upon the clipped parts of the output signal. This results in novel and controllable psycho-acoustic effects.

As mentioned above, adding the 0.6 attenuated version of the Secondary Audio Signal 103 by the Output of Audio Mixer B 113 has the effect of modulating, using the Secondary Audio Signal 103, the clipped parts of the Primary Audio Signal 101, thereby imposing an entirely new wave shape upon the clipped parts of the output signal, while also changing the dynamics of the boundaries between the clipped parts and the un-clipped parts of the wave at Output 115. Thus, changes to the Secondary Audio Signal 103 result in changes to two aspects of the clipped portion of the waveform that are correlated with psycho-acoustic properties which the ear/brain hears as distortion.

The mixing ratio of 0.6 to 1, the ratio of the Secondary Audio Signal amplitude to the Primary Audio Signal amplitude, is implemented by the Audio Mixer B 113 and determines the relative contribution of the two aspects of the clipped waveform that help drive the psycho-acoustic properties of the distortion, the dynamics of the boundary between clipped and un-clipped parts, and the wave shape of the clipped parts.

Ratios higher than 0.6 to 1, wherein the Secondary Audio Signal 103 is attenuated by an attenuation factor of greater than 0.6, will result in perception of the Secondary Audio Signal 103 along with perception of the novel distortion effects created, due to imposition of the Secondary Audio Signal 103 within the clipped portions. Ratios lower than 0.6 to 1 will also result in perception of the Secondary Audio Signal 103 along with perception of the novel distortion effects created, due to imposition of the Secondary Audio Signal 103 within the un-clipped portions. Thus, the ratio of 0.6 to 1 allows the greatest amount of the Secondary Audio Signal 103 to be introduced while minimizing the perception of the Secondary Audio Signal 103 in the output signal 115. Higher levels of the Secondary Audio Signal 103 input to the Audio Mixer B 115 will result in raising the minimum, such that the Secondary Audio Signal 103 becomes more recognizable as audio ghosting of the Secondary Audio Signal 103, which is perceived along with the novel distortion sound. This can provide yet further creative aesthetic possibilities to the musician.

The amplitude of the Secondary Audio Signal 103 cannot be increased indefinitely without causing undesirable noise artifacts. To avoid this problem, the peak amplitude of the Secondary Audio Signal 103 times 0.6 (determined by the mixing ratio of Audio Mixer B) should be less than the absolute clipping threshold voltage of the Inverting Distorter 109, which threshold is typically 0.6 volts in a traditional distorter implementation that employs silicon diodes.

Figure 1B:
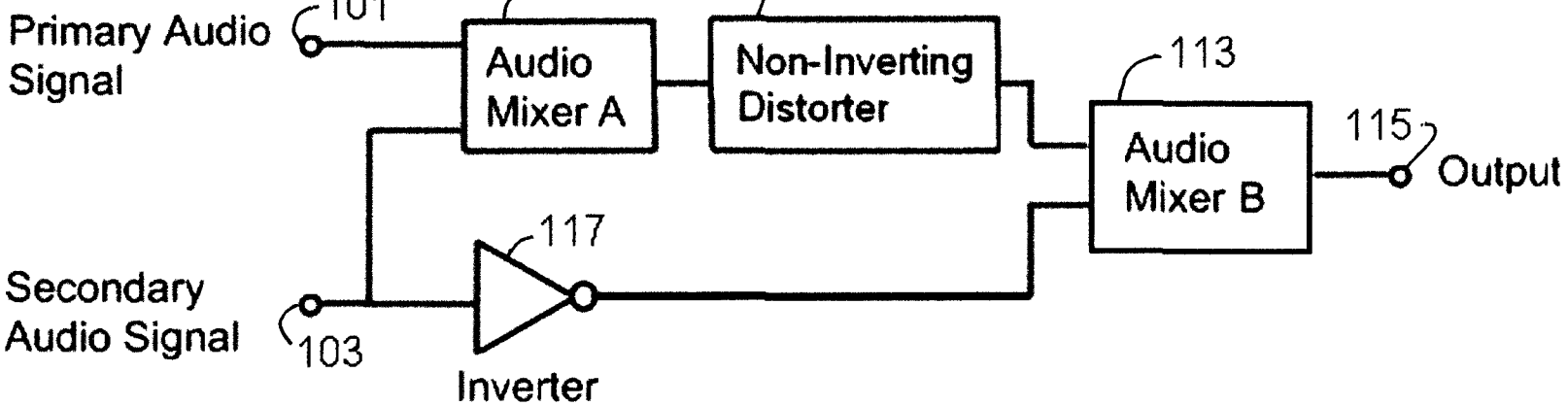
FIG. 1B is a schematic circuit diagram showing an embodiment of the invention having a non-inverting distorter, an inverter, and a second audio mixer having an input ratio of 0.6 to 1.

FIG. 1B shows a basic embodiment of the invention which uses a Non-Inverting Distorter 119 instead of an inverting distorter as shown in FIG. 1A. Consequently, in this embodiment, an Inverter 117 is included so that the polarity of Secondary Audio Signal 103 is reversed when input to Audio Mixer B 113 but not reversed when input to Audio Mixer A 105. This configuration ensures the desired relationship between signals where the polarity of the Secondary Audio Signal component of the Non-Inverting Distorter 119 output signal is opposite to the polarity of the original Secondary Audio Signal 103 when the signals are mixed at Audio Mixer B 113.

Figure 1C:
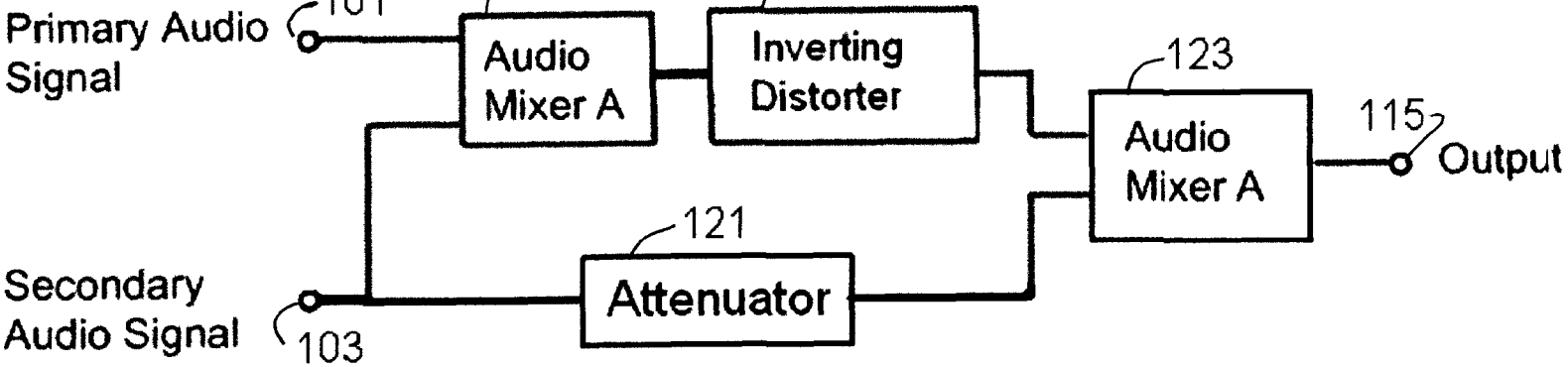
FIG. 1C is a schematic circuit diagram showing an embodiment of the invention having an inverting distorter, an attenuator fixed at 0.6, and a second audio mixer having a 1:1 input ratio.

FIG. 1C shows a basic embodiment of the invention which includes Attenuator 121 providing a 0.6 attenuated version of the Secondary Audio Signal 103 to a 1:1 Audio Mixer A 123 instead of Audio Mixer B 113 as shown in FIG. 1A.

Figure 2:
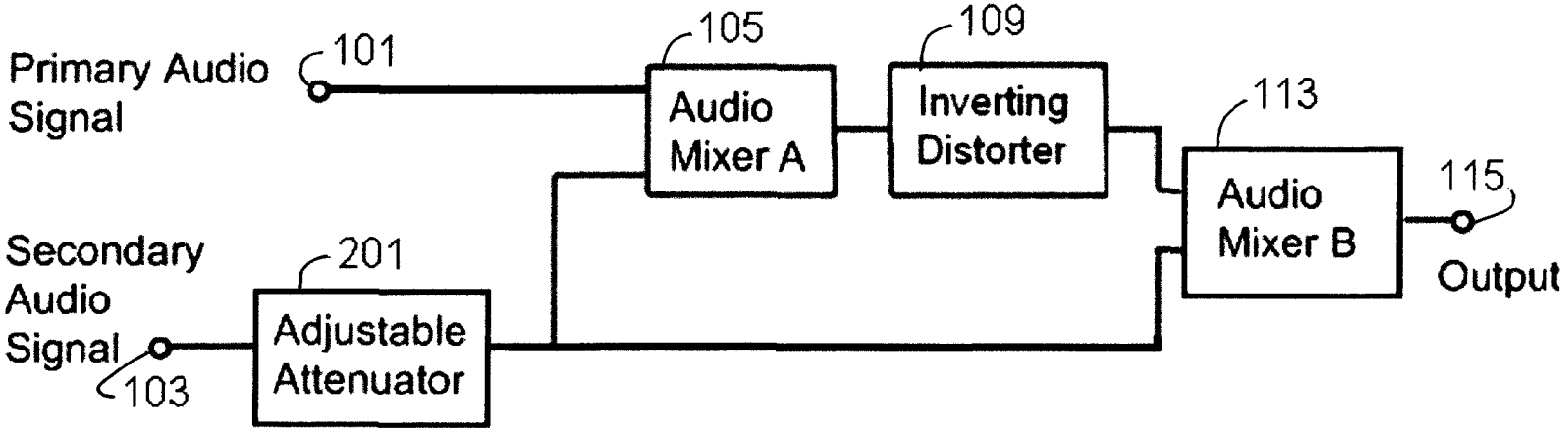
FIG. 2 is a schematic circuit diagram showing an embodiment of the invention having an inverting distorter, an adjustable attenuator, and a second audio mixer having an input ratio of 0.6 to 1.

FIG. 2 shows an enhancement of the embodiment of FIG. 1A where an Adjustable Attenuator 201 is provided that allows the user to adjust the amplitude of the Secondary Audio Signal 103 before it is input to audio mixer A 105 and Audio Mixer B 113. This allows the user to control the impact of the Secondary Audio Signal 103 on the distortion process. Increasing the attenuation will smoothly adjust from a pronounced effect to more subtle effect. With attenuation at maximum, the Secondary Audio Signal 103 has no effect, and the embodiment provides musical distortion in a conventional manner.

Figure 3:
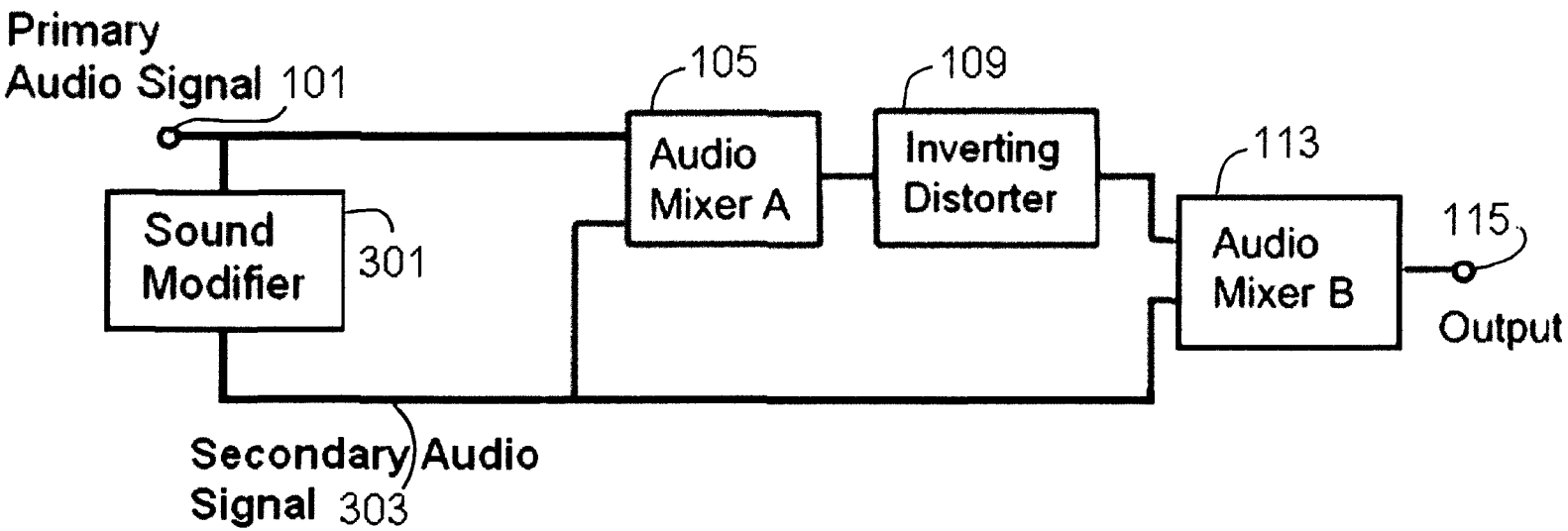
FIG. 3 is a schematic circuit diagram showing an embodiment of the invention having a single audio input signal, a sound modifier to provide a secondary audio input signal, an inverting distorter, and a second audio mixer having an input ratio of 0.6 to 1.

FIG. 3 shows a variation of the embodiment of FIG. 1A where the Secondary Audio Signal 103 is derived by inputting the Primary Audio Signal 101 to the Sound Modifier 301. The Sound Modifier 301 implements any method which serves the purpose of altering the audible characteristics of the Primary Audio Signal 101. The Sound Modifier 301 is configured to accept an audio signal representing sound as its input, and to provide an audio signal representing an altered sound as its output. Sound modifiers of this type are used extensively by musicians and sound engineers, and include filters (which adjust signal level according to frequency), phase shifters, flangers, chorus, distortion, and echo/delay. The waveform-changing action of the Sound Modifier 301 ensures that the wave shape of the signal from the Audio Mixer A 105 supplied to the input of Inverting Distorter 109 is not identical to the wave shape of the Primary Audio Signal, thereby ensuring that the operation of the Inverting Distorter 109 will be influenced by the operation of the Sound Modifier 301. Most sound modifiers allow real-time control of how the sound is changed. In this embodiment, the sound modifier controls (if any) can be used to modify the distortion effect at the Output 115 in real time, something which cannot be achieved in embodiments that use conventional interconnection of sound modifiers and distorters. This embodiment also has the advantage of not requiring a separate external source for providing the Secondary Audio Signal 103, thereby allowing greater simplicity of use, and enabling the user to easily replace a conventional distorter with the distorter of FIG. 3.

Figure 4:
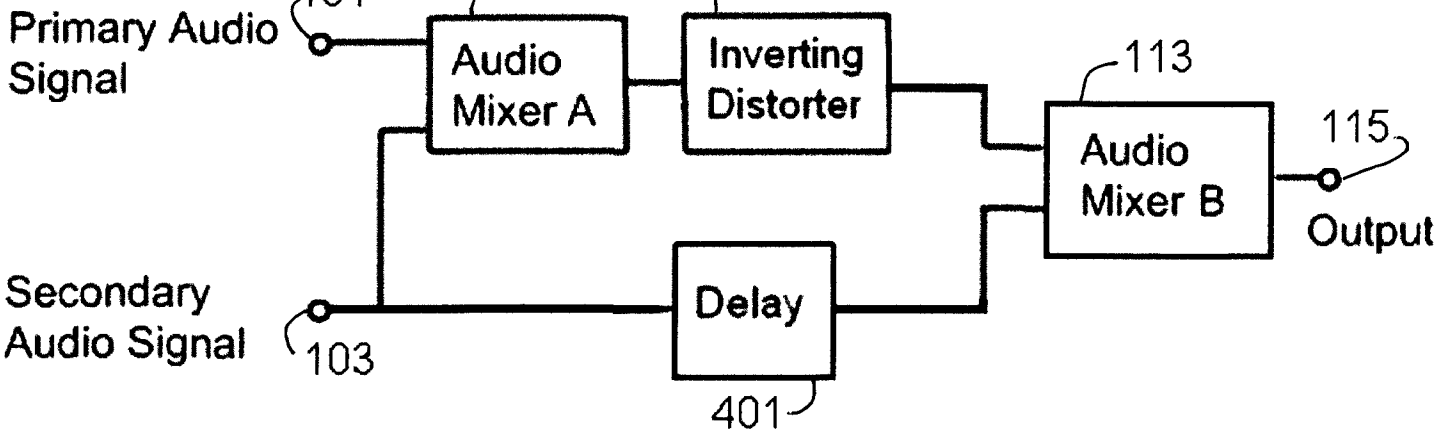
FIG. 4 is a schematic circuit diagram of an embodiment of the invention having a delay element, an inverting distorter, and a second audio mixer having an input ratio of 0.6 to 1.

FIG. 4 shows an modification of the embodiment of FIG. 1A which includes a Delay 401 so that Secondary Audio Signal 103 is delayed before input to Audio Mixer B 113, but not delayed before input to Audio Mixer A. The amount of delay is most usefully set to equal the delay due to Audio Mixer A 105, plus the delay due to Inverting Distorter 109, thereby minimizing the phase error (timing difference) between the Secondary Audio Signal component of the output of the Inverting Distorter 109, and the Secondary Audio Signal 103. In a typical implementation of Audio Mixer A 105 and Inverting Distorter 109, the inherent delay is small, but without the use of Delay 401, there may still be enough phase error to add unwanted noise which degrades the sound quality of the output signal in a subtle manner. The use of Delay 401 has the desirable effect of avoiding noise associated with phase error, thereby allowing the Output Signal 115 to achieve noticeably greater overall clarity. In other embodiments wherein the delay of the non-distorted path of the Secondary Audio Signal might actually be longer than the delay of the distorted signal path, to repair the phase error, the Delay element must be placed in the distorted path instead of in the non-distorted path.

Figure 4A:
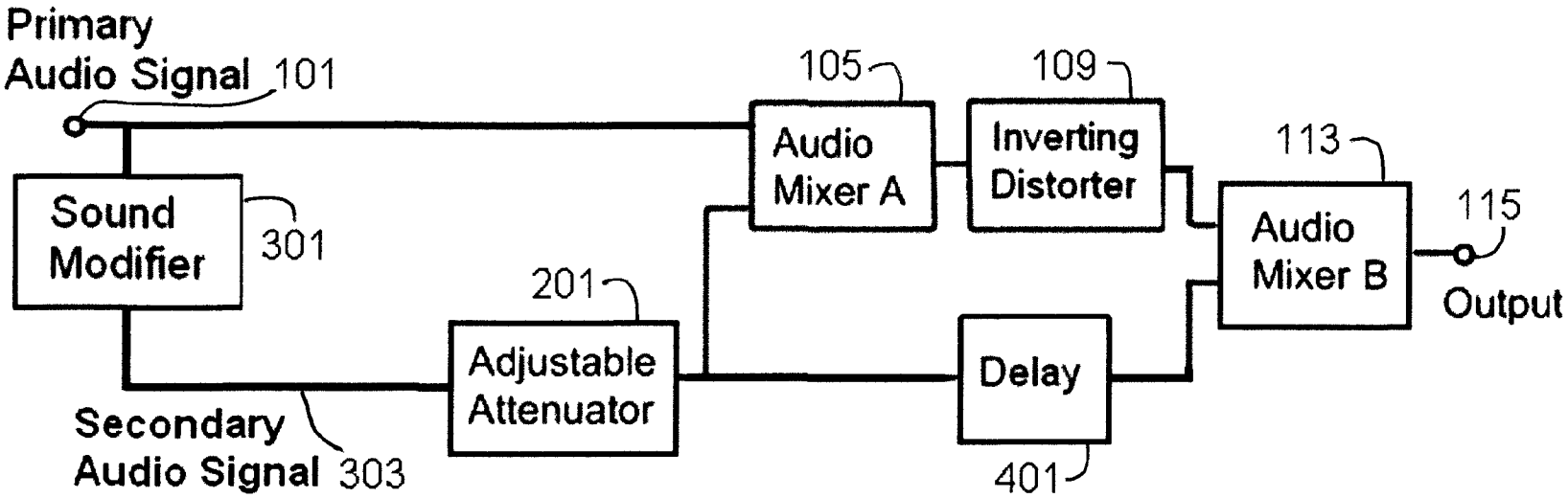
FIG. 4A is a schematic circuit diagram of an embodiment of the invention having a sound modifier, an adjustable attenuator, a delay unit, and a second audio mixer having an input ratio of 0.6 to 1.

FIG. 4A shows a variation on the embodiment of FIG. 1A, wherein the Secondary Audio Signal 303 is derived by applying Sound Modifier 301 to the Primary Audio Signal 101. The Secondary Audio Signal 303 is then attenuated by the Adjustable Attenuator 201 that allows the user to adjust the amplitude of Secondary Audio Signal 303 before it is input to Audio Mixer A 105 and Audio Mixer B 113 via the Delay 401.

The circuit and/or block diagrams in the various drawing figures illustrate the architecture, functionality, and operation of possible implementations according to various embodiments of the present invention. In this regard, each element in the circuit and/or block diagrams may represent one or more modules or components for implementing the specified function(s). It should also be noted that, in some alternative implementations, the functions noted in the circuit and/or block diagrams may occur out of the order noted in the figures. For example, two blocks shown in succession may, in fact, be performed substantially concurrently, or the blocks may sometimes be performed in the reverse order, depending upon the functionality involved. It will also be noted that each element of the circuit and/or block diagrams may be implemented by special purpose hardware-based systems that perform the specified functions or acts, or combinations of special purpose hardware and computer instructions.

Other modifications and variations will be apparent to those of ordinary skill in the art without departing from the spirit and scope of the invention. Accordingly, modifications may be made without departing from the spirit and scope of the invention as claimed.

What is claimed is:

1. A method for audio signal distortion with enhanced control of psycho-acoustic and/or musical effects, the method comprising:

receiving a primary audio signal representing a first musical instrument to undergo audio signal distortion;

receiving a secondary audio signal representing a second musical instrument used to modify psycho-acoustic and/or musical effects of the audio signal distortion;

equally combining the primary audio signal with the secondary audio signal to provide a combined audio signal;

distorting the combined audio signal to provide a distorted signal; and combining the distorted signal with the secondary audio signal, wherein the combining of the distorted signal with the secondary audio signal produces an output signal having non-clipped parts that substantially convey the sound of the first musical instrument, and having clipped parts that convey psycho-acoustic and/or musical effects responsive to the second musical instrument.

2. The method of claim 1, wherein distorting the combined audio signal to provide a distorted signal includes inverting the distorted signal, and combining further includes combining the distorted signal with a non-inverted version of the secondary audio signal.

3. The method of claim 1, wherein the combining comprises combining a non-inverted version of the distorted signal with an inverted version of the secondary audio signal, wherein the secondary audio signal is inverted prior to combining the distorted signal with the secondary audio signal.

4. The method of claim 1, wherein combining the distorted signal with the secondary audio signal is performed in a non-equal ratio.

5. The method of claim 1, further comprising:

delaying the secondary audio signal before combining the distorted signal with the secondary audio signal.

6. An apparatus for audio signal distortion with enhanced control of psycho-acoustic and/or musical effects, the apparatus comprising:

a first input configured to receive a primary audio signal representing a first musical instrument to undergo audio signal distortion;

a second input configured to receive a secondary audio signal representing a second musical instrument used to modify psycho-acoustic and/or musical effects of the audio signal distortion;

a first audio mixer configured to combine the primary audio signal received at the first input with the secondary audio signal received at the second input to provide a combined audio signal at its output;

a distorter configured to distort the combined audio signal to provide a distorted signal; and a second audio mixer configured to combine the distorted signal with the secondary audio signal, wherein the combination of the distorted signal with the secondary audio signal produces an output signal having non-clipped parts that substantially convey the sound of the first musical instrument, and having clipped parts that convey psycho-acoustic and/or musical effects responsive to the second musical instrument.

7. The apparatus of claim 6, wherein the distorter comprises an inverting distorter.

8. The apparatus of claim 6, further comprising:

an inverter configured to invert the secondary audio signal prior to combining the distorted signal with the secondary audio signal in the second audio mixer.

9. The apparatus of claim 6, wherein the second audio mixer includes an attenuator configured to combine the distorted signal with the secondary audio signal in a non-equal ratio.

10. The apparatus of claim 6, further comprising:

an adjustable attenuator for adjustably attenuating the secondary audio signal before equally combining the distorted signal with an attenuated version of the secondary audio signal so as to produce the output signal.

11. A method for distorting an audio signal, the method comprising:

receiving a primary audio signal representing a first musical instrument to undergo audio signal distortion;

receiving a secondary audio signal representing a second musical instrument used to modify psycho-acoustic and/or musical effects of the audio signal distortion;

combining the primary audio signal with the secondary audio signal to provide a combined audio signal;

distorting the combined audio signal to provide a distorted signal; and combining a non-inverted version of the distorted signal with an inverted version of the secondary audio signal, wherein the combining of the non-inverted version of the distorted signal with the inverted version of the secondary audio signal produces an output signal having non-clipped parts that substantially convey the sound of the first musical instrument, and having clipped parts that convey psycho-acoustic and/or musical effects responsive to the second musical instrument.

12. A method for distorting an audio signal, the method comprising:

receiving a primary audio signal representing a first musical instrument to undergo audio signal distortion;

receiving a secondary audio signal representing a second musical instrument used to modify psycho-acoustic and/or musical effects of the audio signal distortion;

combining the primary audio signal with the secondary audio signal to provide a combined audio signal;

distorting the combined audio signal to provide a distorted signal; and combining an inverted version of the distorted signal with a non-inverted version of the secondary audio signal, wherein the combining of the inverted version of the distorted signal with the non-inverted version of the secondary audio signal produces an output signal having non-clipped parts that substantially convey the sound of the first musical instrument, and having clipped parts that convey psycho-acoustic and/or musical effects responsive to the second musical instrument.

* * * * *